US010889988B2

(12) United States Patent
Brand

(10) Patent No.: US 10,889,988 B2
(45) Date of Patent: Jan. 12, 2021

(54) CORROSION-PROTECTED TENSION MEMBER AND PLASTICALLY DEFORMABLE DISC OF CORROSION PROTECTION MATERIAL FOR SUCH A TENSION MEMBER

(71) Applicant: DYWIDAG-SYSTEMS INTERNATIONAL GMBH, Munich (DE)

(72) Inventor: Werner Brand, Freising (DE)

(73) Assignee: DYWIDAG-SYSTEMS INTERNATIONAL GMBH, Munich (DE)

( * ) Notice: Subject to any disclaimer, the term of this patent is extended or adjusted under 35 U.S.C. 154(b) by 0 days.

(21) Appl. No.: 16/293,835

(22) Filed: Mar. 6, 2019

(65) Prior Publication Data

US 2019/0194946 A1 Jun. 27, 2019

Related U.S. Application Data

(62) Division of application No. 14/908,647, filed as application No. PCT/EP2014/066375 on Jul. 30, 2014, now abandoned.

(30) Foreign Application Priority Data

Aug. 1, 2013 (DE) ..... 10 2013 215 136

(51) Int. Cl.
*E04C 5/12* (2006.01)
*E01D 19/14* (2006.01)

(52) U.S. Cl.
CPC ..... *E04C 5/122* (2013.01); *E01D 19/14* (2013.01)

(58) Field of Classification Search
CPC . E01D 19/14; E01D 19/16; E04C 5/12; E04C 5/122; E04C 5/125; E04C 5/127;
(Continued)

(56) References Cited

U.S. PATENT DOCUMENTS 2,303,394 A ‡ 12/1942 Schorer ..... B28B 23/04 52/223.13
2,689,999 A ‡ 9/1954 Peterson ..... B28B 23/04 249/50
(Continued)

FOREIGN PATENT DOCUMENTS

DE 36 44 551 ‡ 7/1988
DE 295 04 739 ‡ 5/1995
(Continued)

OTHER PUBLICATIONS

International Search Report filed in PCT/EP2014/066375 dated Oct. 16, 2014.‡
German Search Report dated Jun. 30, 2014.‡

*Primary Examiner* — Jessica L Laux
(74) *Attorney, Agent, or Firm* — Rankin, Hill & Clark LLP

(57) ABSTRACT

A corrosion-protected tension member (10) comprises a plurality of tension elements (14) and an anchor device (44) with an anchor element (16) which is designed to transmit tension forces from the tension elements (14) to a superior structure (12), at least one elastically compressible sealing disc (28), and a supporting device (26) which is arranged on that side of the at least one sealing disc (28) which faces away from the anchor element (16). According to the invention, when the tension member (10) is in a state in which it is preassembled but not yet placed under tensile stress, at least one plastically deformable disc (30) of
(Continued)

corrosion protection material is arranged between the anchor element (16) and the at least one sealing disc (28).

7 Claims, 4 Drawing Sheets

(58) Field of Classification Search
CPC . E04C 5/01; E04C 5/012; E04C 5/015; E04C 5/017
See application file for complete search history.

(56) References Cited

U.S. PATENT DOCUMENTS 3,041,702 A ‡ 7/1962 Schwab ..... B28B 23/024 249/93
3,162,709 A ‡ 12/1964 Davidson ..... B28B 21/62 138/176
3,225,499 A ‡ 12/1965 Kourkene ..... B28B 23/043 264/228
3,405,490 A ‡ 10/1968 La Marr ..... E04C 5/125 24/122.6
3,427,772 A ‡ 2/1969 Williams ..... E04C 5/125 24/122.6
3,548,432 A ‡ 12/1970 Durkee ..... E01D 19/14 14/18
3,948,010 A ‡ 4/1976 Sonneville ..... B28B 23/043 238/115
4,192,057 A ‡ 3/1980 Borelly ..... B21C 47/02 156/180
4,398,377 A ‡ 8/1983 Romig, Jr. ..... E04C 3/28 29/446
4,592,181 A ‡ 6/1986 Matt ..... E04C 5/12 52/223.13
4,594,827 A ‡ 6/1986 Finsterwalder ..... E04C 5/125 52/223.13
4,663,907 A ‡ 5/1987 Garcia-Mansilla Ripoll ..... E04C 5/122 52/223.13
4,704,754 A ‡ 11/1987 Bonasso ..... E01D 1/00 14/19
4,848,052 A ‡ 7/1989 Nutzel ..... E01D 11/04 52/223.13
5,072,558 A * 12/1991 Sorkin ..... B29C 45/14 52/223.13
5,079,879 A ‡ 1/1992 Rodriguez ..... E04C 5/12 24/122.6
5,263,307 A ‡ 11/1993 Hasui ..... D07B 1/144 57/1 UN
5,469,677 A ‡ 11/1995 Luthi ..... E04C 5/122 24/122.6
5,493,828 A ‡ 2/1996 Rogowsky ..... E04C 5/122 52/223.13
6,476,326 B1 ‡ 11/2002 Fuzier ..... D07B 1/16 174/113 R
6,578,329 B1 * 6/2003 Stubler ..... E04C 5/122 52/223.14
6,748,708 B1 ‡ 6/2004 Fuzier ..... E01D 19/14 24/122.6
7,174,684 B2 * 2/2007 Nuetzel ..... E04C 5/122 52/223.13
7,181,890 B2 ‡ 2/2007 Nuetzel ..... E04C 5/122 52/223.13
8,769,921 B2 * 7/2014 Joye ..... E01D 19/16 57/3
8,869,476 B2 * 10/2014 Delavaud ..... E01D 19/14 52/223.13
9,212,767 B2 ‡ 12/2015 Grayson ..... F16L 1/26
2001/0039686 A1 ‡ 11/2001 Daiguji ..... E04C 5/125 14/21
2002/0088105 A1 * 7/2002 Nutzel ..... E04C 5/122 29/452
2004/0148882 A1 ‡ 8/2004 Hayes ..... E04C 5/12 52/223.14
2004/0237222 A1 * 12/2004 Stubler ..... E01D 19/14 14/22
2005/0034392 A1 ‡ 2/2005 Nuetzel ..... E04C 5/122 52/223.1
2005/0169702 A1 ‡ 8/2005 Paulshus ..... B63B 21/502 403/300
2005/0210782 A1 ‡ 9/2005 Kadotani ..... E04C 5/122 52/223.13
2014/0026372 A1 * 1/2014 Stubler ..... E04C 5/122 24/122.6
2016/0097211 A1 ‡ 4/2016 Deguchi ..... E04H 7/20 52/82

FOREIGN PATENT DOCUMENTS

DE 2732059 A1 ‡ 9/1996
DE 203 11 950 ‡ 1/2005
EP 0 323 285 ‡ 7/1989
EP 0 703 326 ‡ 3/1996
KR 2011 0070422 ‡ 6/2011
KR 20110070422 A ‡ 6/2011
WO 03/083216 10/2003
WO WO-03/083216 ‡ 10/2003
WO 2011/116828 9/2011
WO WO-2011/116828 ‡ 9/2011
WO WO-2011116828 A1 * 9/2011 ..... E01D 19/14
WO WO-2012079625 A1 * 6/2012 ..... E01D 19/14
WO WO-2012140462 A1 * 10/2012 ..... B29C 45/14426
WO WO-2012140463 A1 * 10/2012 ..... E04C 5/122

* cited by examiner
‡ imported from a related application

CORROSION-PROTECTED TENSION MEMBER AND PLASTICALLY DEFORMABLE DISC OF CORROSION PROTECTION MATERIAL FOR SUCH A TENSION MEMBER

The invention relates to a corrosion-protected tension member comprising a plurality of tension elements and an anchor device having an anchor element which comprises through-holes intended for the tension elements to pass through, is in contact with the tension elements so as to absorb tensile forces therefrom, and is designed and intended to indirectly or directly transfer said tensile forces to a higher-level structure, at least one resiliently compressible sealing ring which is arranged on the side of the anchor element facing away from the free ends of the tension elements and which comprises through-holes intended for the tension elements to pass through, and a support device which is arranged on the side of the at least one sealing ring facing away from the anchor element and comprises through-holes intended for the tension elements to pass through.

Corrosion-protected tension members of this kind are used for example as tendons, in particular for prestressed concrete structures such as bridges, tanks or towers, or as stay cables, in particular for cable-stayed structures, in particular cable-stayed bridges, extradosed bridges or arched bridges.

EP 0 703 326 A1 discloses a generic tension member which is used as a tendon for prestressed concrete, and WO 03/083216 A1 discloses a generic tension member which is used as a stay cable for a cable-stayed bridge.

In practice, in the case of all these tension members, there is the problem of corrosion during operation, i.e. in the state when fully assembled and placed under tensile stress, as a result of dirt and moisture penetrating into cavities which exist between the individual components of the tension member. What are critical in this respect are, for example, those points at which the anchor element and the tension elements are in tensile force-transmitting contact, for example using multipart tapered collars. In order to be able to reliably ensure corrosion protection, anti-corrosion material must be labour-intensively injected into said cavities, which results in high assembly costs, in particular due to the working hours of the assembly staff required for this purpose.

The object of the invention is therefore that of providing a corrosion-protected tension member of the type mentioned at the outset, in which the corrosion protection can be ensured in a simple and cost-effective manner.

This object is achieved according to the invention by a tension member of the type mentioned at the outset, in which at least one plastically deformable disc made of an anti-corrosion material is arranged between the anchor element and the at least one sealing ring when the tension member is in a state in which it is pre-assembled but not yet under tensile stress.

The invention takes advantage of the fact that a surface force which is directed substantially in the longitudinal extension direction of the tension elements must, in any case, be exerted on the at least one sealing ring by means of the support device in order to activate the sealing effect of the at least one sealing ring. According to the invention, said surface force compresses not only the at least one sealing ring, but also the at least one plastically deformable disc made of anti-corrosion material, as a result of which the anti-corrosion material is automatically pressed into all the gaps and cavities in the tension member and fills them. The separate work step of injecting anti-corrosion material can therefore be omitted, which reduces the costs of assembling the tension member according to the invention.

According to a first alternative, the surface force mentioned above can be generated independently of stressing the tension elements, for example by means of pushing together the anchor element, the at least one plastically deformable disc, the at least one sealing ring and the support device, by means of a compression device. In this case, said compression device can comprise a plurality of threaded rods which penetrate the above-mentioned elements and are in threaded engagement with threaded nuts on the free surface of the anchor element and the free surface of the support device. According to a second alternative it is, however, also possible to derive the above-mentioned surface force from stressing the tension elements, in that the anchor element, the at least one plastically deformable disc and the at least one sealing ring are pulled against the support device by means of the tension elements, which support device is braced against a bearing shoulder which is fixed to the structure.

In order to be able to ensure that those cavities which are present on the connection points, of the tension elements and the anchor element, which are responsible for tensile force transmission are also reliably filled with anti-corrosion material, it is proposed, in a development of the invention, for the at least one plastically deformable disc made of anti-corrosion material to rest directly on the anchor element when the tension member is in the state in which it is pre-assembled but not yet under tensile stress.

Pre-filling of the gaps and cavities which are to be filled with anti-corrosion agent can be carried out in that the at least one plastically deformable disc made of anti-corrosion material is formed as a complete disc. Since the at least one plastically deformable disc made of anti-corrosion material does not have any through-holes when in the form of a complete disc, in particular no through-holes for guiding through the tension elements, said elements must penetrate the resiliently deformable complete disc during assembly, as a result of which said elements are wetted with anti-corrosion material on the surface thereof. In this case, assembly can be carried out for example by first forming the stacked arrangement of the support device, the at least one sealing ring and the at least one plastically deformable disc, and subsequently threading the tension element through said stacked arrangement.

In principle, however, it is also conceivable for the at least one plastically deformable disc made of anti-corrosion material to comprise through-holes intended for the tension elements to pass through. In this case, the tension elements can first be assembled and subsequently the support device, the at least one sealing ring and the at least one plastically deformable disc can be threaded onto the tension elements.

In principle, any material which has anti-corrosion properties can be used as the anti-corrosion material. However, in terms of the handling of the at least one plastically deformable disc, it is advantageous for the cone penetration of the anti-corrosion material to be of between approximately 60·0.1 mm and approximately 100·0.1 mm at a temperature of 25° C. Anti-corrosion material having a cone penetration above this value range makes it more difficult to produce a plastically deformable disc which can be handled in a simple manner on the construction site, while it is more difficult to completely fill the gaps and cavities with anti-corrosion material in the case of a cone penetration below this value range.

It can be provided in particular for the anti-corrosion material to be microcrystalline wax. A suitable microcrystalline wax can be obtained under the trade name NONTRIBOS® VZ-inject from August Gahringer Carl Gahringer e.K. Fabrik technischer Öle & Fette, for example. Alternatively, however, Vaseline and other petroleum-based duroplastic anti-corrosion materials can also be used.

In order to be able to ensure that a quantity of anti-corrosion material which is sufficient for filling all gaps and cavities is introduced into the anchor device during pre-assembly, it is proposed in a development of the invention for the volume of the anti-corrosion material per tension element to be at least equal to the product of the length of the anchor element in the longitudinal extension direction of the tension elements and the surface area of the annulus between the tension element and the through-hole in the anchor element through which the tension element is guided. In this case, the value of the surface area of the annulus can be between approximately 30 $mm^2$ and 180 $mm^2$.

In order to be able to prevent the excessive loss of anti-corrosion material through the through-holes in the at least one sealing ring which are intended for the tension elements to pass through, when the disc arrangement formed of the at least one sealing ring and the at least one plastically deformable disc is pushed together, it is proposed for the modulus of elasticity of the at least one sealing ring and the resistance of the at least one plastically deformable disc to plastic deformation, respectively based on a compression force acting in the longitudinal direction of the tension elements, to be matched to each other such that the boundary surfaces of the through-holes in the at least one sealing ring are in sealing contact on the tension elements before the at least one plastically deformable disc has been deformed by more than 5% of the thickness thereof measured in the longitudinal direction of the tension elements.

In the event of the value of the cone penetration of the anti-corrosion material being too high for this, it can further be provided for the at least one plastically deformable disc to be assigned at least one resistance element which increases the resistance of said disc to plastic deformation. In this case, the at least one resistance element can be formed from a resiliently and/or plastically deformable element for example. Moreover, the at least one resistance element can be embedded in the anti-corrosion material or can surround the at least one plastically deformable disc, for example in an annular manner. However, irrespective of the exact configuration and arrangement of the at least one resistance element, said element is considered, within the context of the present invention, to be associated with the at least one plastically deformable disc made of anti-corrosion material.

The problem of undesired escape of anti-corrosion material as a result of the plastic deformation of the at least one plastically deformable disc can also occur on the side of the at least one plastically deformable disc which faces away from the at least one sealing ring. In a development of the invention it is therefore proposed, according to a first variant, for the anchor element to have a stamp portion which, when the tension member is in the state in which it is pre-assembled but not yet under tensile stress, engages in a sleeve in which the at least one plastically deformable disc, the at least one sealing ring and the support device are received. According to this first variant, the engagement of the stamp portion of the anchor element in the sleeve forms a seal which at least impedes, if not completely prevents, the undesired escape of anti-corrosion material. Furthermore, the sleeve can be in force-transmitting engagement with the higher-level structure, for example can be embedded in concrete in the higher-level structure, and can have a bearing flange at the end thereof facing the anchor element, with which flange the anchor element is in force-transmitting contact when the tension member is in the state in which it is fully assembled and placed under tensile stress. The above-mentioned bearing shoulder which is fixed to the structure can also be formed on said sleeve.

However, according to a second variant it is also conceivable for the anchor element to be connected in an operationally stable manner to a sleeve in which the at least one plastically deformable disc, the at least one sealing ring and the support device are received. In this second variant, a bearing element can advantageously further be provided which is in force-transmitting engagement with the higher-level structure and with which the anchor element or a force-transferring element connected to said anchor element in an operationally stable manner is in force-transmitting contact when the tension member is in the state in which it is fully assembled and placed under tensile stress. Both operationally stable connections of this variant can be achieved by means of integral formation, screwing, welding or in another suitable manner.

In both variants, it can in addition be advantageous for the at least one plastically deformable disc, the at least one sealing ring and the support device to be guided by the outer peripheral surfaces thereof along an inner surface of the sleeve. Furthermore, in both variants the sleeve can be made of metal, preferably steel, for example as a cast part.

It should also be added that the first variant is suitable for example for surface force generation according to the second alternative explained above, while the second variant is suitable for example for surface force generation according to the first alternative explained above.

As is known per se from the prior art, within the context of the present invention the support device can be formed simply by a spacer disc, which can be manufactured for example from plastics material, in particular polyethylene. In order to also be able to ensure sufficient stability of the support device in the case of tension members having larger diameters, the spacer disc can be manufactured from metal, for example steel. Alternatively, however, it is also conceivable for the support device to also comprise, in addition to the spacer disc, a pressure plate manufactured for example from metal, for example steel.

Moreover, the tension elements of the tension member according to the invention can be tension elements which are known per se. Thus for example what are known as monostrands can be used as tension elements. In this case, a monostrand is understood as a single strand formed from seven wires and surrounded by a cladding of plastics material, preferably polyethylene, the intermediate space between the wires and the cladding being filled with anti-corrosion material, for example anti-corrosion grease. Alternatively, however, strands can also be used which are coated with synthetic resin, for example epoxy resin (known as epoxy-coated strands). In practical use, these two types of tension elements mainly differ in that, in the case of the monostrands, the plastics cladding has to be removed from the point at which the tapered collar transmitting the tensile forces between the tension elements and the anchor element is arranged, whereas the synthetic resin coating can be left in the case of the epoxy-coated strands.

In order to be able to prevent the plastics cladding adversely affecting the force-transmitting contact, for example produced by means of tapered collars, between the anchor element and the tension elements, a sleeve-like retaining element can be arranged between the end of the plastics cladding and the force-transmission point of each tension element. Alternatively, however, it is also conceivable to design the through-holes for the tension elements which are formed in the anchor element, so as to be stepped, the step forming a retaining surface for the plastics cladding. The case mentioned first has the advantage here that it is easily possible to replace individual tension elements.

It should also be added that the at least one sealing ring can be manufactured from a soft rubber, for example nitrile butadiene rubber (NBR, known for example under the trade name Perbunan®) or chloroprene rubber (CR).

The invention further relates to a plastically deformable disc made of anti-corrosion material which is intended and designed to be used in a corrosion-protected tension member according to the invention.

The invention will be described in further detail in the following, on the basis of the accompanying drawings and with reference to two embodiments. In the drawings:

FIG. 1 shows a tendon 10, such as can be used in particular for prestressed concrete structures such as bridges, tanks or towers, as a first embodiment of a corrosion-protected tension member according to the invention, in the state thereof when fully assembled and stressed in the concrete of the prestressed concrete structure 12.

Figure 1:
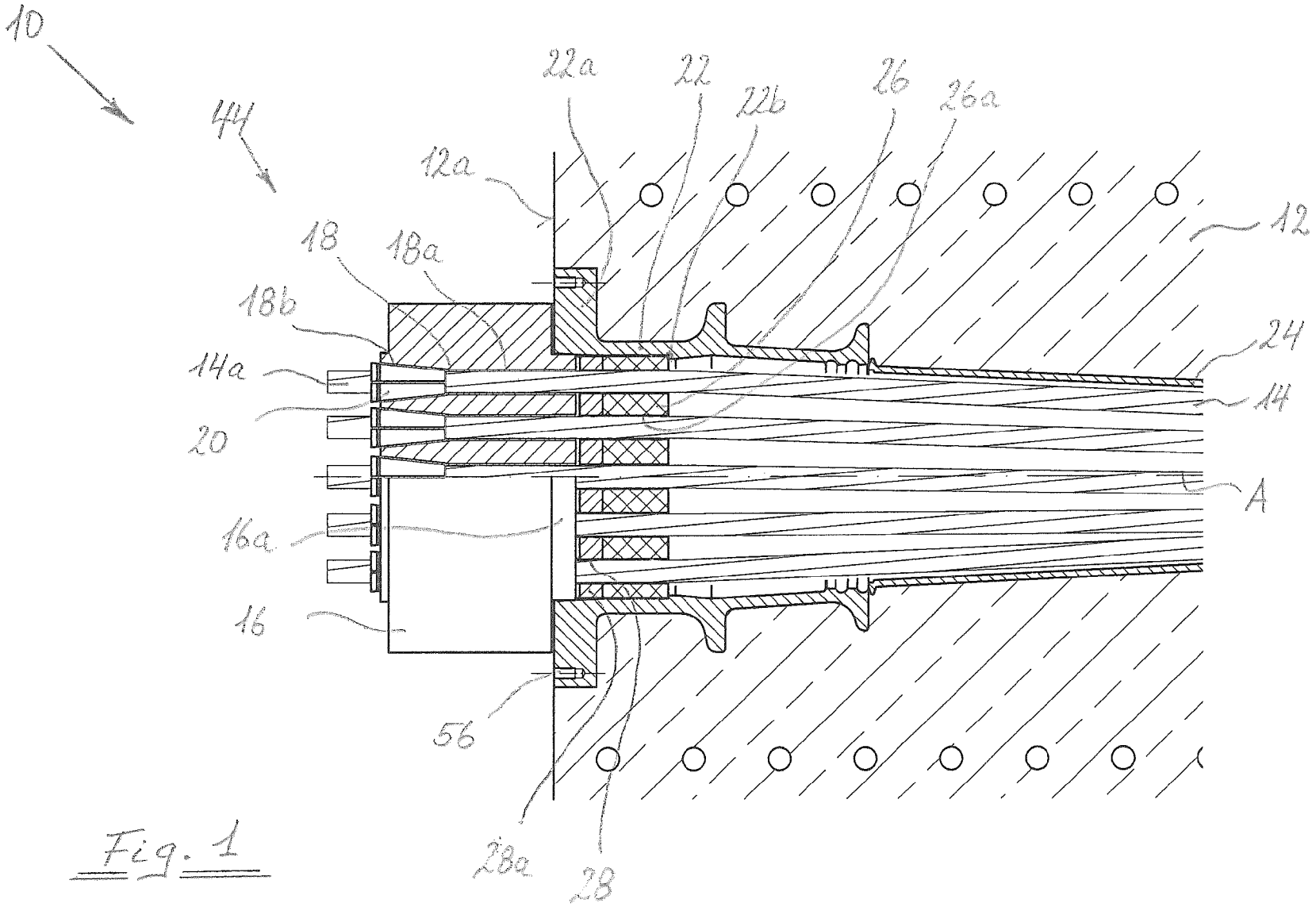
FIG. 1 is a longitudinal section through a tension member according to the invention which can be used as a tendon, in particular for prestressed concrete structures, when in the fully assembled and stressed state.

The tendon 10 comprises a plurality of tension elements 14, each of which can be formed of a steel wire strand coated with synthetic resin. Epoxy resin, for example, can be used as the synthetic resin, the tension elements 14 in this case being referred to for short in technical language as "epoxy-coated strands".

The tension elements 14 are in tensile-force transmitting contact with an anchor disc 16 which is manufactured from steel for example. For this purpose, the anchor disc 16 is provided with a plurality of through-holes 18 which each have an inner cylindrical portion 18*a* which transitions into a conical portion 18*b* on the side facing away from the prestressed concrete structure 12. Each of the conical portions 18*b* is used to receive a multipart tapered collar 20 which encompasses the associated tension element 14 with a positive and non-positive fit and transmits the tensile forces from the tension element 14 to the anchor disc 16.

The anchor disc 16 is supported on the outer surface 12*a* of the structure 12 by means of an abutment flange 22*a* of a substantially tubular anchor body 22 which is embedded in concrete in the structure 12 and can be manufactured for example as a cast part, in particular made of cast iron. The anchor body 22 forms a tubular covering for the tension elements 14 extending from the surface 12*a* of the structure 12 towards the inside of the structure 12, which covering can be lengthened, if desired, towards the inside of the structure 12 by means of a further tube 24. A smooth or profiled plastics tube for example, in particular a polyethylene tube, a sheet metal tube or the like, can be used as the further tube 24.

The tension elements 14 which extend inside the structure 12 slightly obliquely relative to the tension axis A of the tension member 10 are deflected by means of a spacer disc 26 arranged inside the anchor body 22 so as to penetrate the anchor disc 16 in a manner extending substantially in parallel with the tension axis A. For this purpose, the spacer disc 26 is provided with a plurality of correspondingly formed through-holes 26*a*. The spacer disc 26 can be manufactured for example from plastics material, in particular polyethylene.

Furthermore, a sealing ring 28 is arranged on the side of the spacer disc 26 facing the anchor disc 16, which ring in turn comprises a plurality of through-holes 28*a* for the tension elements 14 to pass through. The sealing ring 28 can be manufactured for example from a soft rubber, for example nitrile butadiene rubber or chloroprene rubber.

When the tension member 10 according to the invention is in the state in which it is fully assembled and stressed, the sealing ring 28 is supported on the spacer disc 26. In order to be able to provide the support for the sealing ring 28, the spacer disc 26 can in turn be indirectly or directly supported on the anchor body 22. In the embodiment shown, said disc is supported on an inner annular shoulder 22*b* of the anchor body 22 for example. If the internal stability of the spacer disc 26 were not sufficient for this, for example due to too large a diameter, a further support disc, preferably manufactured from metal, could in addition be provided between the spacer disc 26 and the annular shoulder 22*b*.

Figure 2:
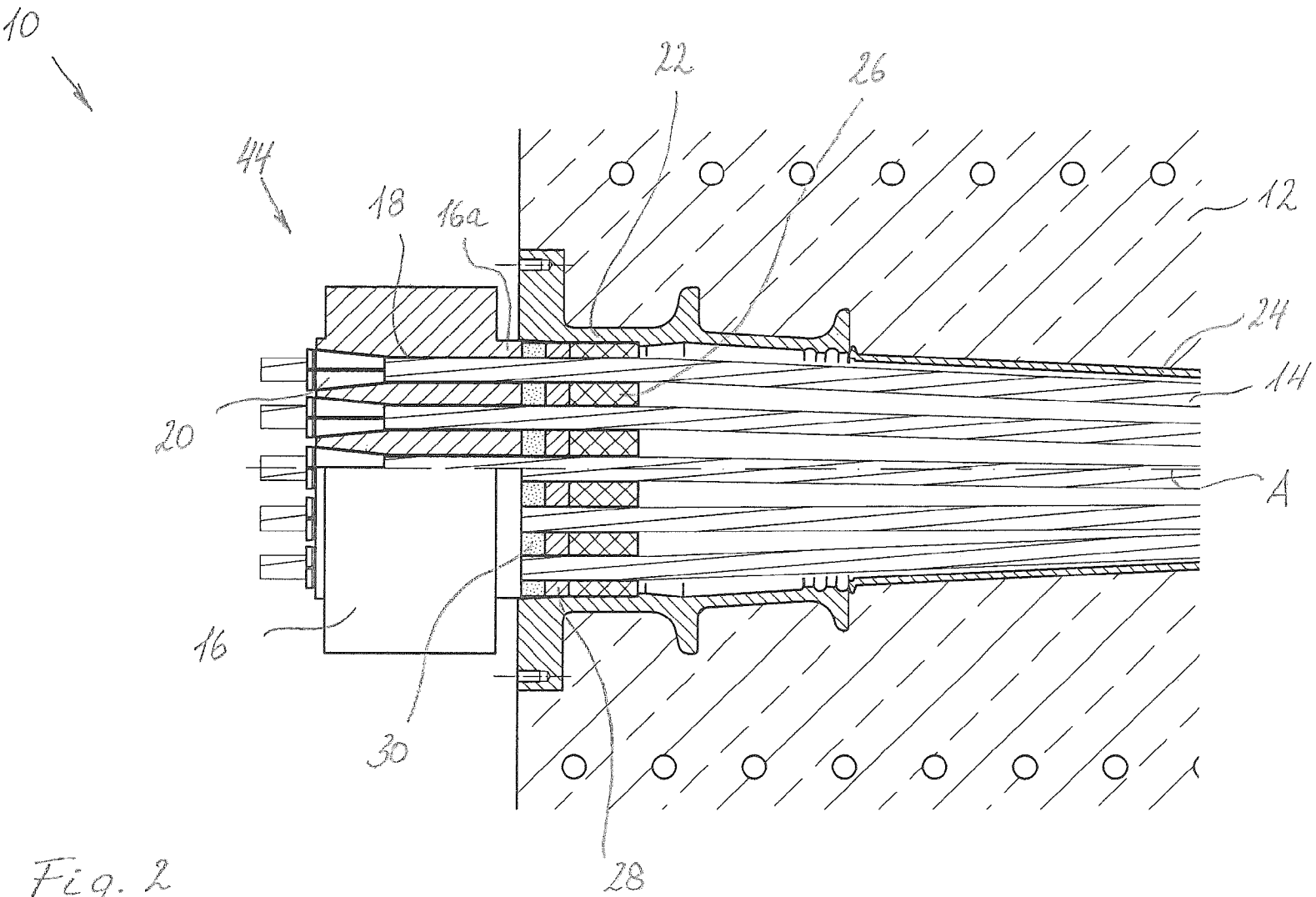
FIG. 2 is a longitudinal section of the tension member according to FIG. 1 when in the pre-assembled but not yet stressed state.

As can be seen in particular from FIG. 2, according to the invention a plastically deformable disc 30 made of anti-corrosion material is further arranged between the sealing ring 28 and the anchor disc 16 during assembly of the tension member 10. This plastically deformable disc 30 made of anti-corrosion material can also comprise a plurality of through-holes for the tension elements 14. However, this is not necessarily required. Rather, the plastically deformable disc 30 can also be formed as a complete disc, meaning that the tension elements 14 have to be pushed through the plastically deformable material of the disc 30 during assembly, as a result of which the surface of said elements is, at this time, already wetted with anti-corrosion material.

When stressing the tension member 10, a stamp portion 16*a* of the anchor disc engages in the anchor body 22 and presses against the plastically deformable disc 30. Since said plastically deformable disc is clamped between the anchor disc 16 and the sealing ring 28 it plastically deforms such that the anti-corrosion material is automatically, i.e. as part of the stressing process, pressed into all the cavities still present in the tension member 10 when said member is unstressed, in particular into the cavities present between the tension elements 14 and the inner walls of the through-holes 18 and in the tapered collars 20. Since these cavities are thus substantially completely filled with anti-corrosion material, penetration of moisture and dirt can be reliably prevented. In order to achieve the same aim, up to now in the prior art the anti-corrosion material has had to be injected later, after stressing the tension member. This was laborious and complex in particular due to the fact that the anti-corrosion material had to be injected into each of the tapered collars in succession, resulting in high assembly costs due to the associated requirement for staff.

In order to be able to prevent the anti-corrosion material from not only being pressed into the above-mentioned cavities but also being able to escape through those cavities between the tension elements 14 and the inner walls of the through-holes 28*a* in the sealing ring 28 and the through-holes 26*a* of the spacer disc 26, care must be taken to ensure that the material of the sealing ring 28 is first placed in a sealing manner around the tension elements 14 before the disc 30 made of anti-corrosion material is significantly plastically deformed. This can be achieved for example in that the modulus of elasticity of the sealing ring 28 and the resistance of the plastically deformable disc 30 to plastic deformation, respectively based on a compression force acting in the longitudinal direction of the tension elements 14, are matched to each other with a view to achieving this aim.

Figure 3:
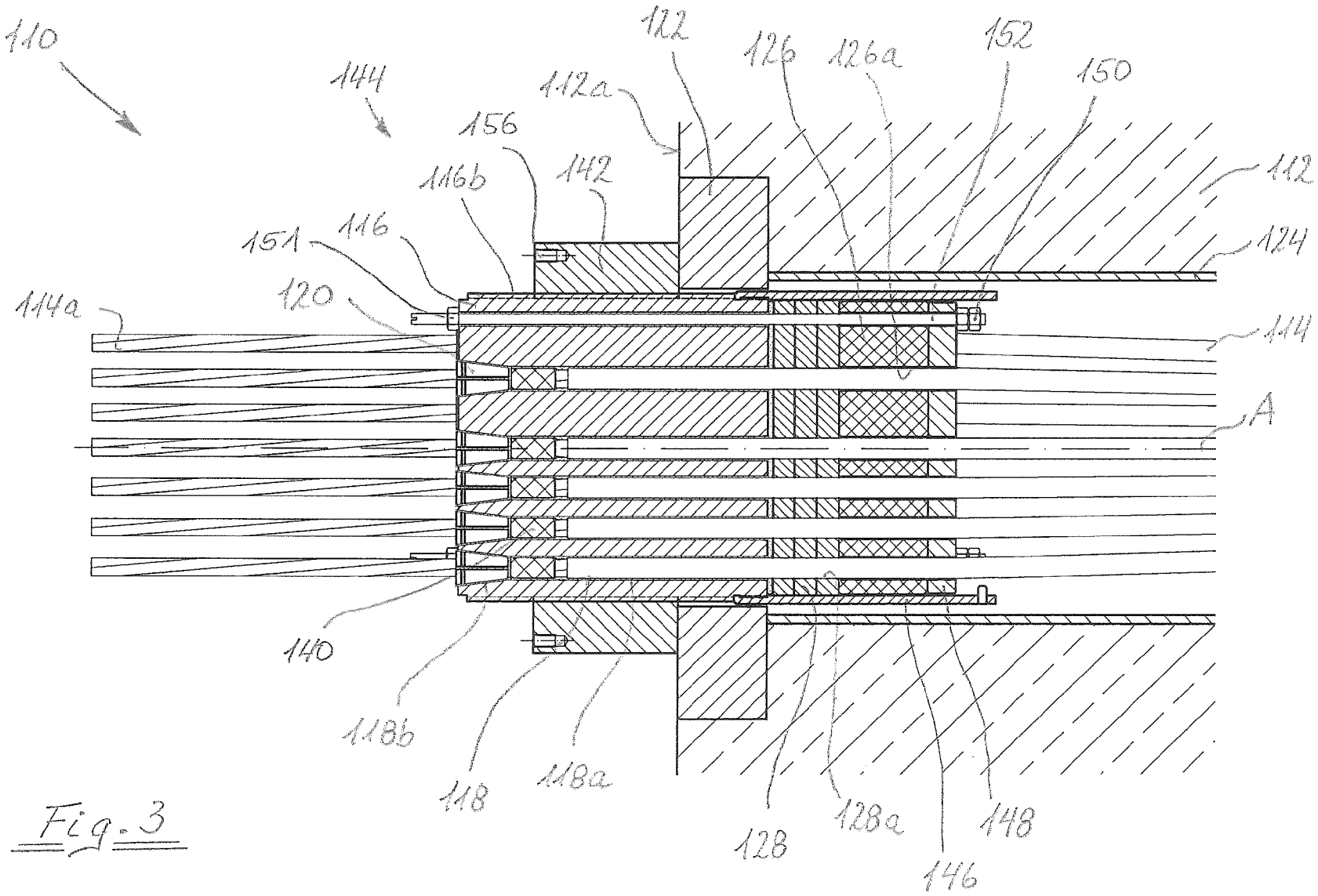
FIGS. 3 and 4 are longitudinal sections similar to FIGS. 1 and 2 of another tension member according to the invention which can be used as a stay cable, in particular for cable-stayed structures.
Figure 4:
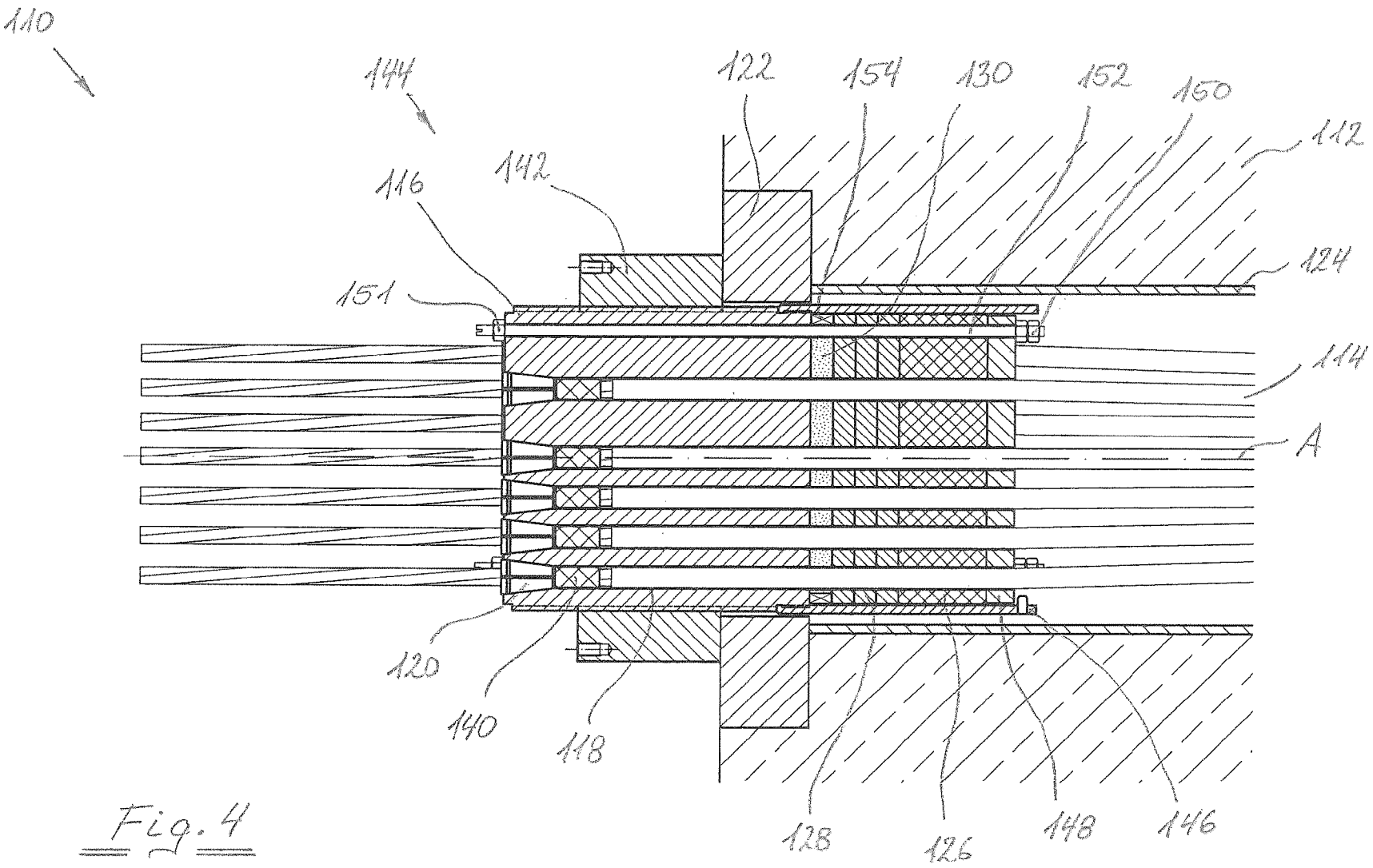

FIGS. 3 and 4 show a second embodiment of a tension member according to the invention. In this case, the embodiment according to FIGS. 3 and 4 differs from the embodiment according to FIGS. 1 and 2 mainly in that it does not relate to a tendon 10 such as is used in particular for prestressed concrete structures, but relates to a stay cable such as is used in particular in cable-stayed structures, for example cable-stayed bridges, extradosed bridges or arched bridges. Therefore, in FIGS. 3 and 4 similar parts are provided with the same reference signs as in FIGS. 1 and 2, but increased by 100. In addition, the tension member or the stay cable 110 is described in the following only to the extent that it differs from the tendon 10 of FIGS. 1 and 2, to the description of which reference is otherwise explicitly made hereby.

The tension member or stay cable 110 comprises a plurality of individual tension elements 114, each of which can be formed for example as monostrands. In this case, a monostrand is understood as a single strand formed from seven wires and surrounded by a cladding of plastics material, preferably polyethylene, the intermediate space between the wires and the cladding being filled with anti-corrosion material, for example anti-corrosion grease.

The tension elements 114 are in tensile force-transmitting contact with an anchor disc 116 manufactured from steel for example. For this purpose, the anchor disc 116 is provided with a plurality of through-holes 118, like the anchor disc 16 of the embodiment according to FIGS. 1 and 2. Conical portions 118*b* of the through-holes 118, which are connected to cylindrical portions 118*a*, are used to receive tapered collars 120 which encompass the tension elements 114 with a positive and non-positive fit. In order to be able to prevent the cladding of the tension elements 114 from adversely affecting the engagement of the tapered collars 120 with said tension elements, in practice the cladding of the tension elements 114 is removed at the point at which the tapered collars 120 are arranged. This can be seen in FIGS. 3 and 4 from the fact that, in the portions of the tension elements 114 (on the left-hand side in FIGS. 3 and 4) in which the cladding has been removed, the torsion of the wires of the strands is indicated by oblique lines, whereas the tension elements 114 in the clad portions (on the right-hand side in FIGS. 3 and 4) are shown having smooth walls. In addition, it has been found to be advantageous to arrange spacer sleeves 140 on the strands, between the end of the cladding and the tapered collars 120.

The outer peripheral surface of the anchor disc 116 is provided with a thread 116*b*, on which a ring nut 142 is screwed. The anchor disc 116 and the ring nut 142 together form an anchor device 144 which is supported on the outer surface 112*a* of the structure 112 via a bearing plate 122. More precisely, the anchor device 144 is supported on the bearing plate 122 by means of the ring nut 142. The bearing plate 122 can be manufactured from steel for example. Furthermore, said plate can be inserted in a recess in the structure 112 provided for this purpose, or can be embedded in concrete in the structure 112. In principle, however, the anchor device 144 can also be directly supported on the structure 112.

Regarding the embodiment of FIGS. 1 and 2, it should also be added that the anchor device 44 there consists purely of the anchor disc 16.

A tube 124 can be connected to the bearing plate 122 inside the structure 112, which tube protects the tension elements 114 from the concrete of the structure 112. The tube 124 can be a smooth or profiled plastics tube for example, in particular a polyethylene tube, a smooth or profiled metal tube, in particular a steel tube, or the like.

It should further be noted that the anchor disc 116 is connected to a further tube 146 inside the concrete of the structure 112. The further tube 146 can be screwed onto the anchor disc 116 for example or welded thereto. A spacer disc 126 is received in this further tube, which spacer disc deflects the tension elements 114, which extend slightly obliquely relative to the tension axis A of the tension member 110 inside the concrete of the structure 112, such that said tension elements penetrate the anchor disc 116 in a manner extending substantially in parallel with the tension axis A. For this purpose, the spacer disc 126 is provided with a plurality of correspondingly formed through-holes 126*a*. The spacer disc 126 can be manufactured from plastics material for example, in particular polyethylene.

In the embodiment shown, three sealing rings 128 are arranged on the side of the spacer disc 126 facing the anchor disc 116, which sealing rings likewise comprise a plurality of through-holes 128*a* for the tension elements 114 to pass through. The sealing rings 128 can be manufactured for example from a soft rubber, for example nitrile butadiene rubber or chloroprene rubber. In principle, however, it is also conceivable to use fewer or more than three sealing rings.

In the fully assembled and stressed state of the tension member 110 according to the invention, the sealing ring 128 which is furthest from the anchor disc 116 is supported on the spacer disc 126. In order to thus be able to act as an abutment for the three sealing rings 128, the spacer disc 126 is in turn supported on a support disc 148 which is preferably manufactured from metal. The support disc 148 is in turn held on the anchor disc 116 by means of a plurality of threaded rods 152 fitted with threaded nuts 150, 151.

As can be seen in particular from FIG. 4, during assembly of the tension member 110 according to the invention, a plastically deformable disc 130 made of anti-corrosion material is further arranged between the sealing ring 128 closest to the anchor disc 116 and the anchor disc 116. This plastically deformable disc 130 made of anti-corrosion material can also comprise a plurality of through-holes for the tension elements 114. However, in the same way as in the embodiment of FIGS. 1 and 2, this is not necessarily required. Rather, the plastically deformable disc 130 can also be formed as a complete disc, meaning that the tension elements 114 have to be pushed through the plastically deformable material of the disc 130 during assembly, as a result of which the surface thereof is wetted with anti-corrosion material.

A further difference between the embodiments of FIGS. 1 and 2 on the one hand and FIGS. 3 and 4 on the other hand consists in the fact that, in the case of the tension member or stay cable 110, the process of stressing the tension elements 114 is separated from the process of activating the sealing rings 128 and the plastic deformation of the disc 130 made of anti-corrosion material, whereas both processes take place simultaneously according to the above description of the tension member or tendon 10 of FIGS. 1 and 2.

After the tension member 110 has been stressed, the sealing rings 128 can be activated and the disc 130 made of anti-corrosion material can be plastically deformed, whereby the threaded nuts 151 of the threaded rods 152 are tightened. Since the disc 130 is clamped between the anchor disc 116 and the sealing rings 128, said disc plastically deforms such that the anti-corrosion material is automatically, i.e. as part of this second stressing process, pressed into the cavities still present in the tension member 110 when said member is unstressed, in particular into the cavities present between the tension elements 114 and the inner walls of the through-holes 118 and in the tapered collars 120. Again, the subsequent injection of anti-corrosion material after the tension member has been stressed, which has been necessary up to now in the prior art, can be eliminated in this manner.

Furthermore, in this case, in the embodiment of FIGS. 3 and 4 there is also the risk that the anti-corrosion material is not only pressed into the above-mentioned cavities but is also able to escape through those cavities between the tension elements 114 and the inner walls of the through-holes 128*a* in the sealing rings 128 and the through-holes 126*a* of the spacer disc 126. Again, this can be prevented in that care is taken to ensure that the material of the sealing rings 128 is first placed in a sealing manner around the tension elements 114 before the disc 130 made of anti-corrosion material is significantly plastically deformed. This again can be achieved for example in that the modulus of elasticity of the sealing rings 128 and the resistance of the plastically deformable disc 130 to plastic deformation, respectively based on a compression force acting in the longitudinal direction of the tension elements 114, are matched to each other with a view to achieving this aim. However, it is also possible to embed at least one resistance element 154 in the plastically deformable disc 130, which element increases the resistance of said disc to plastic deformation, in a manner which is adapted to the modulus of elasticity of the sealing rings 128.

Of course, at least one resistance element of this kind can also be used in the embodiment according to FIGS. 1 and 2.

Regarding both embodiments, it should also be added that the free ends 14*a* and 114*a*, respectively, of the tension elements 14 and 114, respectively, projecting out of the anchor disc 16 and 116, respectively, can be protected from external influences, in particular weather-related influences, by means of a cap (not shown) which can preferably be filled with anti-corrosion material. The fixing points for said cap are provided on the abutment flange 22*a* in the embodiment of FIGS. 1 and 2 and are denoted by 56 therein, whereas they are provided on the ring nut 142 in the embodiment of FIGS. 3 and 4 and are denoted by 156 therein.

The invention claimed is:

1. A method for providing a corrosion-protected tension member, the method comprising:

providing tension elements and an anchor device including an anchor element, at least one resiliently compressible sealing ring arranged on a side of the anchor element facing away from free ends of the tension elements after the tension elements have been passed through the anchor device, a support device arranged on a side of the at least one sealing ring facing away from the anchor element, and at least one plastically deformable disc made of an anti-corrosion material and arranged between the anchor element and the at least one sealing ring;

passing the tension elements through the anchor element, the at least one resiliently compressible sealing ring, the support device and the at least one plastically deformable disc while the tension member is in a first state in which the tension member is pre-assembled but not yet under tensile stress such that the anchor element is in contact with the tension elements to absorb tensile forces therefrom when the tension member is in a second state in which the tension member is fully assembled and stressed; and exerting a tensile force on the tension elements in a longitudinal extension direction of the tension elements which compresses the sealing ring and the at least one plastically deformable disc resulting in the anti-corrosion material being pressed into gaps and cavities in the tension member, wherein providing the tension elements and the anchor device further includes providing the at least one plastically deformable disc having no through-holes, and passing the tension elements through the anchor element, the at least one resiliently compressible sealing ring, the support device and the at least one plastically deformable disc further includes penetrating the at least one plastically deformable disc resulting the tension elements being wetted with the anti-corrosion material on a surface thereof.

2. The method of claim 1, wherein providing the tension elements and the anchor device further includes providing the anchor device such that the at least one plastically deformable disc rests directly on the anchor element when the tension member is in the first state.

3. The method of claim 1, wherein providing the tension elements and the anchor device further includes providing the at least one plastically deformable disc being made of microcrystalline wax.

4. The method of claim 1, wherein providing the tension elements and the anchor device further includes providing the at least one plastically deformable disc, wherein the volume of the anti-corrosion material per tension element is at least equal to the product of the length of the anchor element in the longitudinal extension direction of the tension elements and the surface area of an annulus between each tension element and a through-hole in the anchor element through which each tension element is passed.

5. The method of claim 1, wherein providing the tension elements and the anchor device further includes providing the at least one plastically deformable disc, wherein the modulus of elasticity of the at least one sealing ring and the resistance of the at least one plastically deformable disc to plastic deformation, respectively based on a compression force acting in the longitudinal direction of the tension elements, are matched to each other such that boundary surfaces of through-holes in the at least one sealing ring are in sealing contact on the tension elements before the at least one plastically deformable disc has been deformed by more than 5% of a thickness thereof measured in the longitudinal direction of the tension elements.

6. The method of claim 5, wherein providing the tension elements and the anchor device further includes providing at least one resistance element embedded in the at least one plastically deformable disc which increases a resistance of said plastically deformable disc to plastic deformation.

7. The method of claim 1, wherein providing the tension elements and the anchor device further includes providing the anchor element including a stamp portion which, when the tension member is in the first state, engages in a sleeve in which the at least one plastically deformable disc, the at least one sealing ring and the support device are received.

* * * * *